US005291857A

United States Patent [19]

Braun, Jr.

[11] Patent Number: 5,291,857

[45] Date of Patent: Mar. 8, 1994

[54] PORTABLE ANIMAL RESTRAINING DEVICE FOR USE IN MEDICAL TESTING

[76] Inventor: Oscar Braun, Jr., 30 Hillcrest Ave., Washington, N.J. 07882

[21] Appl. No.: 921,252

[22] Filed: Jul. 29, 1992

[51] Int. Cl.[5] ..... A61D 3/00

[52] U.S. Cl. ..... 119/751; 128/869

[58] Field of Search ..... 119/98, 96, 99, 19, 119/151, 143; 43/60, 62; 128/846, 869, 870

[56] References Cited

U.S. PATENT DOCUMENTS

| | | | |
|---|---|---|---|
| 629,865 | 8/1899 | Marshall . | |
| 1,200,557 | 10/1916 | Whitmore | 119/19 |
| 1,240,277 | 9/1917 | Williams | 119/159 X |
| 1,359,905 | 11/1920 | Molyneux | 119/98 |
| 2,498,051 | 2/1950 | Shipley . | |
| 2,630,097 | 3/1953 | Johansen . | |
| 3,237,602 | 3/1966 | Kens | 119/98 |
| 4,133,295 | 1/1979 | Jones | 119/98 |
| 4,181,095 | 1/1980 | Sylogye | 119/19 |
| 4,228,765 | 11/1980 | Berlin . | |
| 4,372,251 | 2/1983 | Keith | 119/19 |
| 4,498,425 | 2/1985 | Aanestad | 119/96 |
| 4,498,425 | 2/1985 | Aanestad . | |
| 4,520,758 | 6/1985 | Pfriender | 119/19 |
| 5,019,031 | 5/1991 | Towfighi et al. | 128/846 |
| 5,133,291 | 7/1992 | Justice | 119/19 |

*Primary Examiner*—Gene Mancene
*Assistant Examiner*—Todd E. Manahan
*Attorney, Agent, or Firm*—Robert E. Bushnell

[57] ABSTRACT

A portable animal restraining device, comprising two side restraining members for restricting lateral movement; a front restraining member, joining each of the two side restraining members, for restricting forward movement; a rear restraining member joining each of the two side restraining members restricting rearward movement; a top restraining member joining the two side restraining members is disclosed, the rear restraining member, and the front restraining member. The rear restraining member is provided with two substantially parallel vertical slots allowing access to each rear leg of the subject animal. A subject animal is placed into the restraining device by lowering the device over top of the animal.

16 Claims, 2 Drawing Sheets

PORTABLE ANIMAL RESTRAINING DEVICE FOR USE IN MEDICAL TESTING

FIELD OF THE INVENTION

The present invention relates to laboratory restraining devices for animals, and more specifically, to portable, hand carryable restraining devices for larger quadrupedal animals.

DESCRIPTION OF RELATED ART

Quadrupedal animals, such as pigs, are used in the medical testing in a number of areas. For instance, since pigs' hearts are similar to those of humans, pigs have wide applications in medical testing.

Medical testing animals must be restrained during injections or blood taking since stress associated with these procedures can cause the animals to run or bite. In view of the animals' size, manual attempts to physically restrain the animals can be both difficult and dangerous.

Moreover, a restraining device suitable for use in the laboratory environment should be portable and easy to use. The device should also minimize the possibility of injury to both the laboratory worker and the animal.

The farrowing pen of Johansen (U.S. Pat. No. 2,630,097) is an example of a large class of inventions drawn to restraining devices to prevent sows from crushing piglets, both during birth and suckling. The design of this invention suffers from a number of deficiencies. Its large size and bulky construction make it non-portable. Its chute configuration complicates operation since the hog must be coaxed into the pen. Furthermore, the design makes no provision for human access to the hog while in the pen, although piglets can enter from underneath.

The combined hog trap and crate of Marshall (U.S. Pat. No. 629,865) concerns a restraining device for hogs. As in Johansen, this device also incorporates the chute configuration complicating its use. Marshall includes access doors which allow medical procedures to be performed on the hog. Opening of these access doors, however, will allow the hog to kick and possibly injure an operator; therefore, complete restraint of the hog is not possible. A further shortcoming lies in the fact that a clamping lever is required to keep the hog in the trap, a feature that could injure the hog's neck, and which requires a second operator dedicated to maintaining tension on the lever during the medical procedure.

The animal restrainer of Aanestad (U.S. Pat. No. 2,498,425) discloses a restraining device for calves. The principal drawback of this device is the complexity of its operation. The calf must be placed into the restrainer, its head must be placed into the nose harness, and a chain must be placed underneath the jaw. These are features which combine to deny the device any capacity for quick operation.

The animal holder of Shipley (U.S. Pat. No. 2,498,051) and the rabbit restraining box of Berlin (U.S. Pat. No. 4,228,765) both contemplate devices for holding rabbits during scientific experimentation. Both of these inventions are only appropriate for smaller animals however, since the animal must be essentially manhandled into the restraining boxes. Furthermore, their operation is complex since the body of an animal must be clamped into the devices. Finally, Shipley only provides access to only the rabbit's head, whereas Berlin only provides limited access to the rabbit's hindquarters.

SUMMARY OF THE INVENTION

It is an object of the current invention to provide an improved animal restraining device.

It is another object to provide a hand holdable, portable animal pen.

It is a further object to provide a portable animal pen capable of restricting movement of an animal while enabling unrestricted access to both hind quarters of the animal.

A portable animal restraining device, may be constructed with two side restraining members for restricting lateral movement; a front restraining member joining each of the two side restraining members, for restricting forward movement; and a rear restraining member joining each of the two side restraining members for restricting rearward movement; a top restraining member joining the two side restraining members, the rear restraining member, and the front restraining member. The rear restraining member is provided with two substantially parallel vertical slots allowing access to each rear leg of the subject animal. A subject animal is confined within the restraining device by simply manually lowering the device over top of the animal.

DETAILED DESCRIPTION OF THE INVENTION

Figure 1:
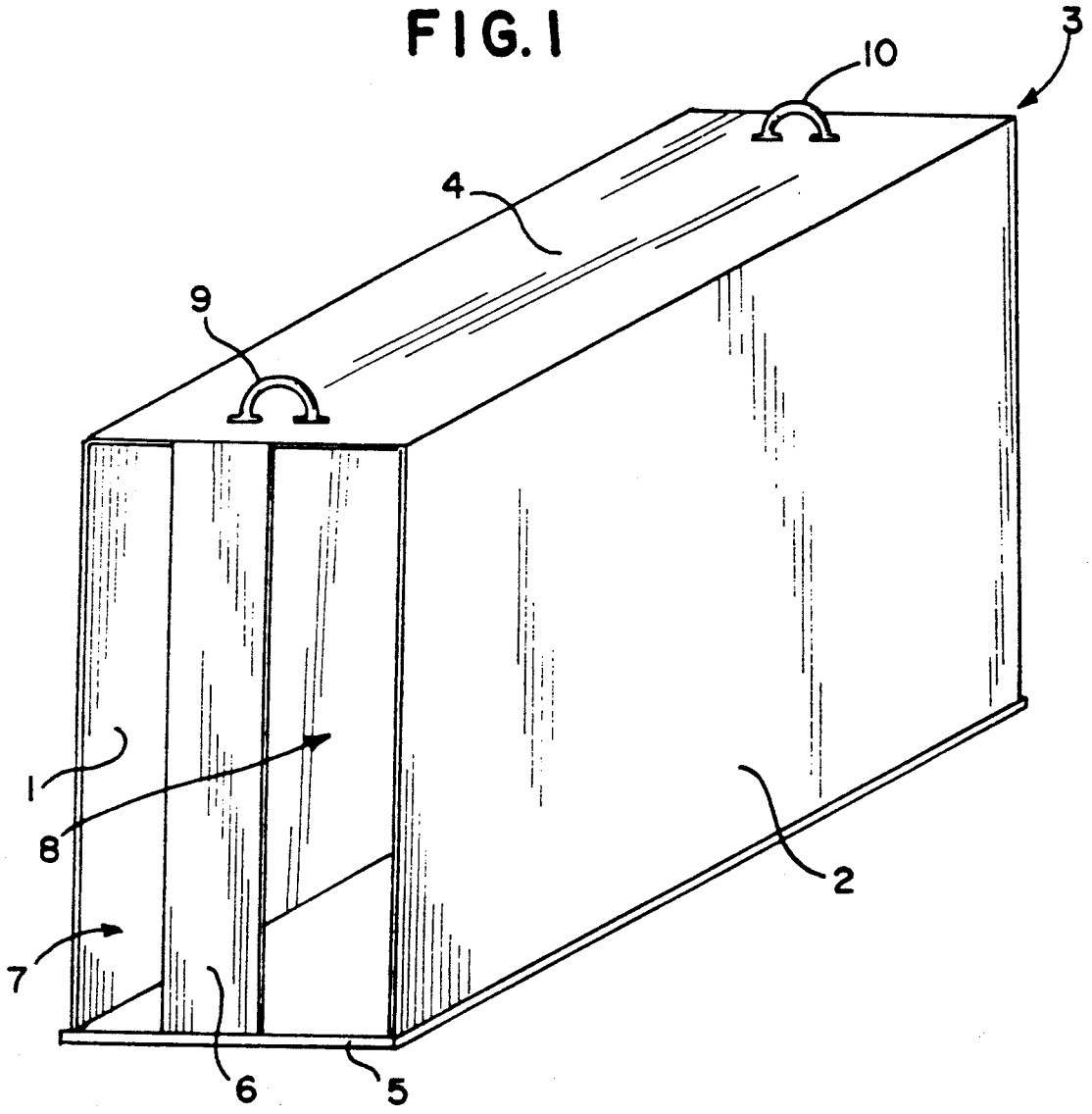
FIG. 1 is a top elevational view of one embodiment constructed according to the principles of the present invention.
Figure 2:
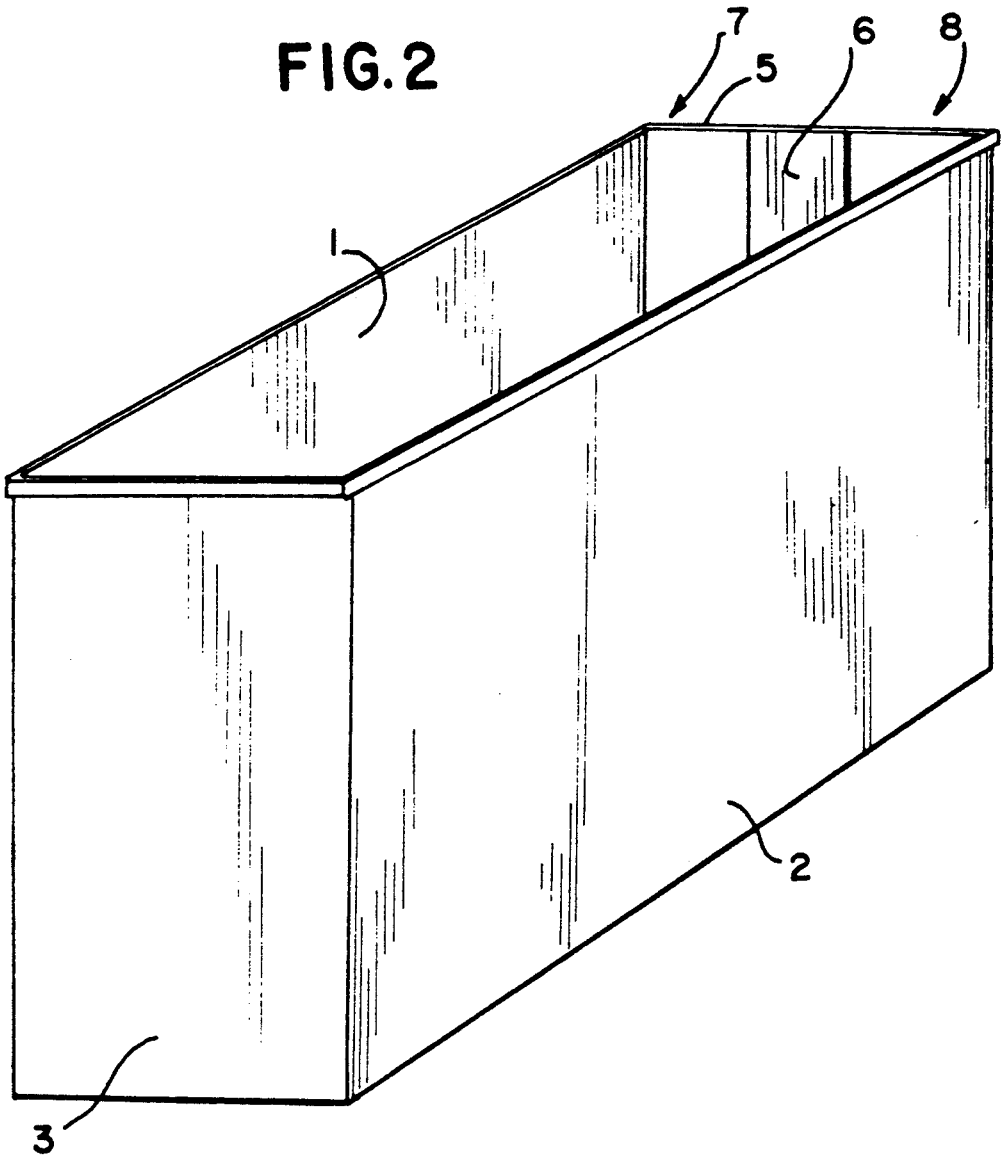
FIG. 2 is a bottom view of the embodiment shown in FIG. 1.

Turning now to drawings, FIGS. 1 and 2 show as embodiment of the present invention constructed essentially as the configuration of a box with an open bottom. The configuration has two opposing solid side walls 1 and 2 joined by both a solid front wall 3 and a solid top wall 4. A rear wall portion is formed by a bottom horizontal cross beam 5 and vertical member 6 connecting the solid top wall with the bottom horizontal cross beam.

Vertical member 6 is preferably positioned off-center, that is, at different, or unequal, distances from sidewalls 1, 2 in order to assure substantially complete access to one of the hindquarters while preventing the animal from squeezing out between member 6 and sidewall 2.

In effect, the off-center vertical member 6 joins the bottom horizontal cross beam 5 at an off-center point so that left and right slots 7 and 8 on either side of the center member are different sizes.

Handles 9 and 10 may be placed at both ends of the top wall to facilitate handling of the device. The device is preferably constructed of stainless steel to ease cleaning and prevent transmission of disease. The device can also be constructed of molded fiberglass.

The restraining device is operated by manually lifting it above an animal such as a pig, and then placing it over the pig. Either of the two hind legs of the confined pig may then be safely pulled through one of the two slots disposed on either side of the off-center vertical member to allow for example, manual administration of injections as, for example, with hypodermic needles.

The size and proportions of the restraining device are important. For instance, if the device is much longer than the pig, grasping a hind leg of the pig will be difficult. Also, if the device is too wide, the pig could turn around within the device after it has been placed over the pig, thereby defeating its purpose. Moreover, a device which is too short or too narrow will not properly fit over the pig. The approximate ideal relative proportions of the device should be 1:2.5:3, width:height:length. In one embodiment, a device for a 110 pound pig should be approximately 10 inches wide, 24 inches in height, and 30 inches long.

I claim:

1. A portable animal restraining device, comprising a box including an open bottom, a substantially solid front wall, top wall and sidewalls, and a rear wall, said rear wall comprising a bottom horizontal cross beam and a vertical beam joining said top wall and said bottom cross beam at right angles, said vertical beam delineating a first vertical slot and a second vertical slot for providing access to hindquarters of an animal held within said restraining device; wherein the animal is introduced into said restraining device through the open bottom by placing said restraining device over the animal.

2. The portable restraining device of claim 1, wherein said first vertical slot is approximately 3.5 inches wide.

3. The portable animal restraining device of claim 2, wherein said second vertical slot is approximately 2.5 inches wide.

4. A portable animal restraining device for restraining an animal of known general dimensions, said device comprising:

two oppositely disposed, spaced apart side restraining members for restricting lateral movement of said animal;

a front restraining member, joining each of said two side restraining members and comprising a solid front wall continuously joining said two side restraining members, for restricting forward movement;

a rear restraining member, joining each of said two side restraining members, for restricting rearward movement, said rear restraining member comprising a bottom horizontal cross beam and a vertical beam joining said bottom horizontal cross beam at a right angle, said vertical beam delineating a first slot and a second vertical slot for providing access to hindquarters of said animal; and a top restraining member joining each of said two side restraining members, said rear restraining member, and said front restraining member, said bottom horizontal cross beam joining said top restraining member at a right angle;

wherein said side restraining members, front restraining member and rear restraining member define an open bottom portion for receiving the animal into said restraining device; a distance between said side restraining members, and a distance between said open bottom portion and said top restraining member, and a distance between said front restraining member and said rear restraining member are selected so as to not substantially exceed said known dimensions and thereby prevent said animal from turning around while within said restraining device.

5. The portable animal restraining device of claim 4, wherein said two side restraining members comprise solid side walls.

6. The portable animal restraining device of claim 4, wherein said top restraining member comprises a solid top wall continuously joining each of said two side restraining members and said front restraining member.

7. The portable animal restraining device of claim 4, wherein said top restraining member is provided with handles for lifting and placing said restraining device.

8. A portable animal restraining device as claimed in claim 4, wherein a ratio of said distance between said side restraining members, said distance between said open bottom portion and said top restraining member, and said distance between said front restraining member and said rear restraining member is approximately 1:2.5:3.

9. A portable animal restraining device, comprising a box having an open bottom and including a solid front wall, top wall and sidewalls, and a rear wall, said rear wall comprising a bottom horizontal cross beam and a vertical beam joining said top wall and said bottom cross beam at right angles, said vertical beam delineating a first vertical slot and a second vertical slot for providing access to hindquarters of an animal of known general dimensions held within said restraining device; wherein the animal is introduced into said restraining device through the open bottom by placing said restraining device over said animal, distances between said sidewalls are selected in dependance upon said known general dimensions so as to prevent said animal from turning around while in said restraining device, and distances between said front wall and said rear wall are selected in dependence upon said known general dimensions so as to prevent said animal from evading a grasp of a person reaching through said first vertical slot for said hindquarters.

10. The portable animal restraining device of claim 9, wherein said distance between said sidewalls defines a width, a distance between said open bottom and said top wall defines a height, and said distance between said front wall and rear wall defines a length, wherein a ratio of said width to said height to said length is approximately 1:2.5:3.

11. The portable animal restraining device of claim 10 wherein said front wall, said top wall and said sidewalls are comprised of stainless steel.

12. The portable animal restraining device of claim 10, wherein said front wall, said top wall and said sidewalls are comprised of molded fiberglass.

13. The portable animal restraining device of claim 9, wherein a width is approximately 10 inches, a height is approximately 24 inches, and length is approximately 30 inches.

14. A portable animal restraining device, comprising a box having an open bottom and including a substantially solid front wall, top wall and sidewalls, and a rear wall, said rear wall comprising a bottom horizontal cross beam and a vertical beam joining said top wall and said bottom cross beam at right angles, said vertical beam delineating a first vertical slot and a second vertical slot for providing access to hindquarters of an animal of known general dimensions held within said restraining device; wherein said animal is introduced into said restraining device through said open bottom by placing said restraining device over said animal, a distance between said sidewalls defines a width, a distance between said open bottom and said topwall defines a height, and a distance between said front wall and said rear wall defines a length, wherein a ratio of said width to said height to said length is approximately 1:2.5:3.

15. A process for restraining an animal for medical testing, said process comprising:

placing an open bottomed restraining device down over said animal, said restraining device comprising a front wall, a top wall, sidewalls, and a rear wall, said rear wall having a first vertical slot, wherein distances between said sidewalls are selected in dependance upon general dimensions of said animal so as to prevent said animal from turning around while in said restraining device, and distances between said front wall and said rear wall are selected in dependence upon said general dimensions so as to prevent said animal from evading a grasp of a person reaching through said first vertical slot for a hindquarter of said animal;

reaching in through said first vertical slot and grasping said hindquarter of said animal;

withdrawing said hindquarter through said first vertical slot; and removing blood from or performing an injection into said hindquarter.

16. A process as claimed in claim 15, wherein said rear wall comprises a bottom horizontal cross beam and a vertical beam joining said top wall and said bottom cross beam at right angles, said vertical beam delineating said first vertical slot and a second vertical slot.

* * * * *